United States Patent [19]

Piatt

[11] Patent Number: 4,929,207

[45] Date of Patent: May 29, 1990

[54] BODY SURFBOARD WITH ADDED FLOTATION

[76] Inventor: John A. Piatt, 226 Getchell St., Santa Cruz, Calif. 95060

[21] Appl. No.: 310,957

[22] Filed: Feb. 16, 1989

[51] Int. Cl.[5] ..... B63B 43/14

[52] U.S. Cl. ..... 441/65; 114/123; 441/74; 441/79

[58] Field of Search ..... 441/65, 74, 79; 114/123, 283, 39.2, 352

[56] References Cited

U.S. PATENT DOCUMENTS

| | | | |
|---|---|---|---|
| 3,115,860 | 12/1963 | Payne | 441/65 |
| 4,688,504 | 8/1987 | Sulz et al. | 114/283 |
| 4,719,952 | 1/1988 | Geronimo | 441/74 |

FOREIGN PATENT DOCUMENTS

| | | | |
|---|---|---|---|
| 0026721 | 4/1981 | European Pat. Off. | 114/123 |
| 3639296 | 4/1988 | Fed. Rep. of Germany | 114/39.2 |
| 2113156 | 8/1983 | United Kingdom | 114/123 |

*Primary Examiner*—Joseph F. Peters, Jr.
*Assistant Examiner*—Edwin L. Swinehart
*Attorney, Agent, or Firm*—Robert Charles Hill; Gerald L. Moore

[57] ABSTRACT

The combination of a body surfboard (10) and a pair of floats (20) and (21) attached together by fasteners (30), (31) and (32) passing through holes (35), (42) and (44) in the float members and similar holes in the board. A reinforcing web (50) bonded to the outer surface of a portion of each float and a reinforcing rod (52) inserted into a hole drilled from the end of each float serve to reinforce each float against breakage while allowing limited bending of the rear extension (27).

3 Claims, 2 Drawing Sheets

BODY SURFBOARD WITH ADDED FLOTATION

BACKGROUND OF THE INVENTION

1. Field of the Invention

This invention relates to an improvement in body surfboards.

2. Description of the Prior Art

Body surfboards are lightweight floats on which a swimmer can lie for paddling across the water or ride while being propelled by waves. Usually such boards are made of polystyrene foam or polyethylene foam and are approximately 2 inches thick, 20 inches wide and 40 inches long. "Board" will refer to the above foam body surfboards or any other board in which attachment of pontoon flotation would be applicable. Naturally, the flotation is limited such that the boards actually sink down in the water when the swimmer rests on them. This sinking substantially increases the drag of the board in the water making it more difficult to plane when paddling over the surface and riding the waves in the surf. The sinking also decreases the stability of the board.

It is the purpose of the subject invention to improve the flotation and stability of a body surfboard by adding auxiliary floats on the outside edges and extending past the swimmer on both sides. These auxiliary floats are designed to increase the utility of the surfboard.

SUMMARY OF THE INVENTION

A foam body surfboard including a planar member having forward, rear and side edges, a pair of float members fixed to the top surface of the board, each float member being positioned adjacent a side edge and extending past the rear edge so as to form therebetween a space for the person to lie. The float members are reinforced to allow flexing for accommodating various sizes of swimmers and to enhance the stability of the board.

DESCRIPTION OF A PREFERRED EMBODIMENT OF THE INVENTION

Figure 1:
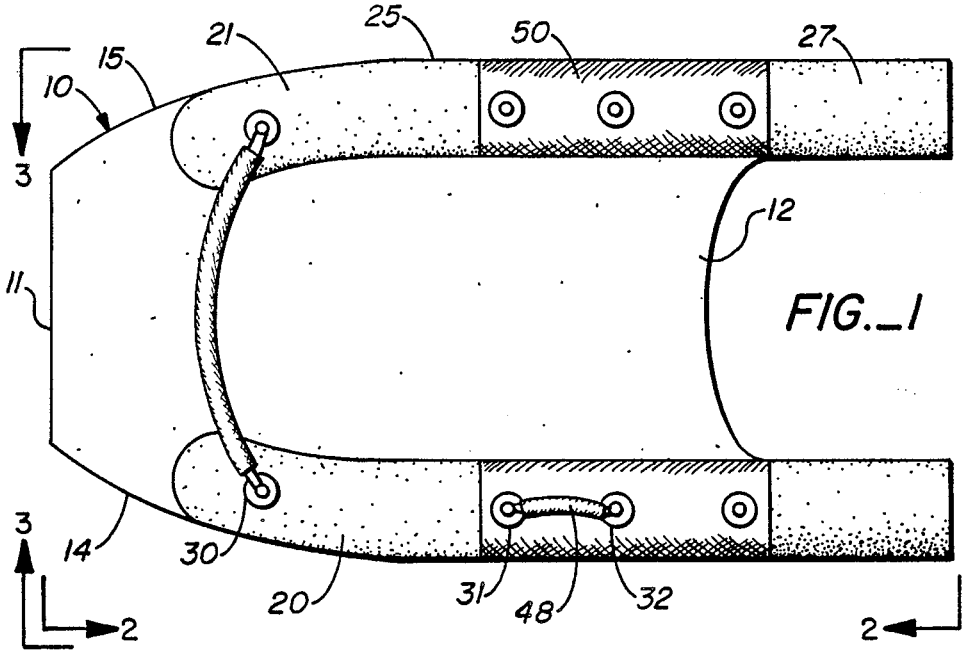
FIG. 1 is a top view of a body surfboard incorporating the present invention.
Figure 2:
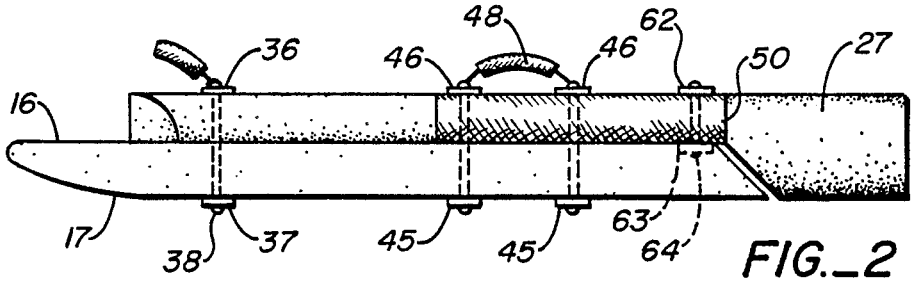
FIG. 2 is a view along the line 2—2 of FIG. 1.
Figure 3:
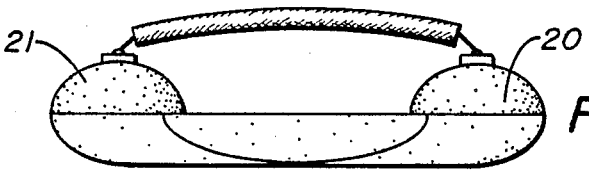
FIG. 3 is a view along the line 3—3 of FIG. 1.
Figure 4:
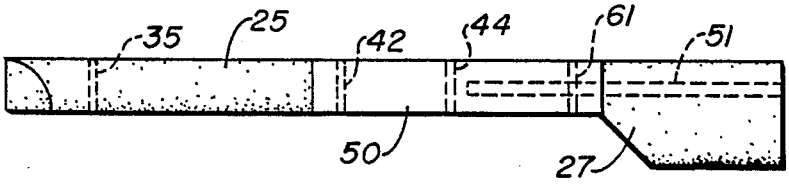
FIG. 4 is a side view of a float.

In FIG. 1 is shown a body surfboard 10 comprising a front edge 11, a rear edge 12 and side edges 14 and 15. The board usually is made of a buoyant material such as closed cell polyethylene foam having a top surface 16 and a bottom surface 17 such that a person can lie with the upper torso on the board and float across the water. Experience has shown that with a board sized to fit the upper torso of a swimmer and yet be easily manageable in the water, the weight of the human body will force the board down and cause considerable drag in the water. The drag makes difficult any planing action during surfing.

In accordance with the present invention there is added to the foam board 10, float members 20 and 21 comprising closed cell polyethylene or other material members that are formed to fit along the edges 14 and 15 of the board 10 and extend past the rear edge 12. Each member includes a section 25 which conforms to the contour of the top surface 16. A buoyant rear extension 27 is fixed to each float member and extends behind the board.

These float members are fixed to the surfboard by such means as fasteners 30, 31 and 32. The floats can also be bonded. The fastener 30 extends through holes 35 near the front edge 11 of the board in the direction from the top surface 16 to the bottom surface 17. Thus, each end of the fastener 30 goes through a washer 36 centered over the hole 35 in the float, through the float and the board and a second washer 37 adjacent the bottom surface 17 of the board to terminate in a knot or other fastener 38. A knot 41 or other fastener can be positioned adjacent the top washer 36 if desired.

The ties 31 and 32 are passed through washers 36 positioned adjacent the holes 42 and 44 in the floats 20 and 21, respectively, and held there by knots or other fasteners with washers 45 and 46 adjacent the bottom and top surfaces of the board 10 and the floats, respectively. Similarly, a sleeve 48 on each tie provides a gripping member which the surfer can use to hang onto the board and to carry the board.

Figure 7:
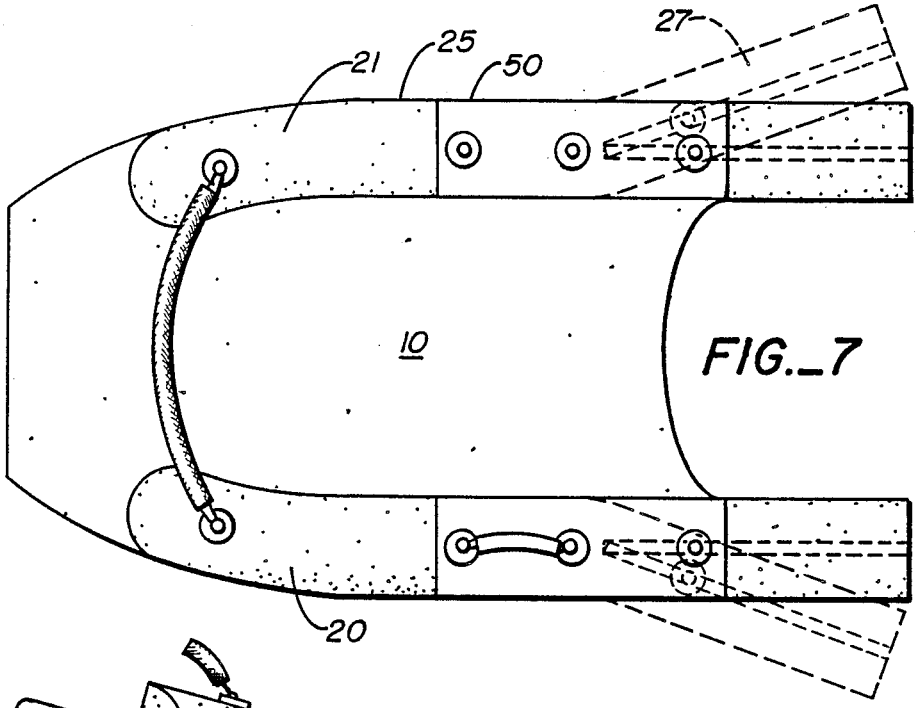
FIG. 7 shows the flexing of the floats to accommodate the swimmer.

To increase the utility of the float and surfboard combination just described, the rear extension 27 of the float is made to pivot generally about the area of the opening 44 to accommodate the body of the surfer. In this manner various body sizes fit on the board however, as shown in FIG. 7 the extension 27 will pivot outward to the dotted line position and then spring back to the regular position so as to fit snugly against the surfer's body. Thus the surfer is held more snugly on the board.

Figure 6:
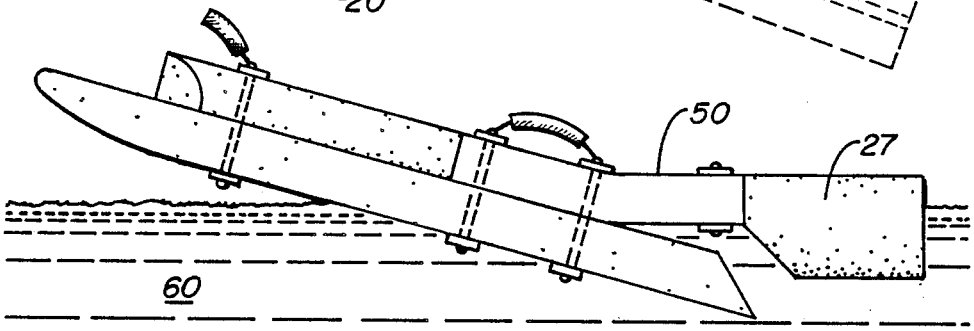
FIG. 6 shows the manner the floats flex when in the water.
Figure 5:
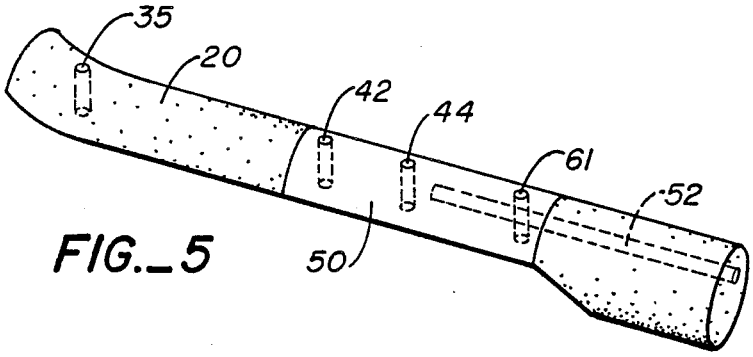
FIG. 5 is a perspective view of a float.

Also as shown in FIG. 6, the extension 27 will also pivot upward from the plane of the board 10 as the board rides upward under the weight of the surfer's body resting primarily near the back edge of the board. The water 60 thereby drags less on the float and surfing is made easier.

To strengthen the floats primarily at the bending area there is bonded and/or otherwise mechanically fastened (see lines 14–18 page 3) and the tie 64 passed through washers 62 and 63 positioned adjacent to hole 61, held there by knots or other fastener with washers 62 and 63, to the mid-section of each a vinyl sheath made of nylon cord webbing or other material 50 which extends around and serves as a reinforcing member for the area subjected to the most stress. Thus, if bending forces are exerted on the extending ends 27 of the float, the nylon webbing will limit the possibilities of breakage. To further strengthen the float, a hole 51 is drilled from the rear end of each float generally close to the center axis. Thereafter a semi-rigid stiffener member 52 is inserted into this hole and preferably glued in place to strengthen the extending end 27. It is important to include this extending end so as to support more of the torso of the swimmer while allowing the surfer to readily push up on the board while in the water and to use his legs to propel the board forward. Also the floats can serve as fences for gear stowed on the board.

I claim:

1. The method of adding buoyancy to a a body surfboard having front, side and rear edges, comprising the steps of:

providing a pair of buoyant float members which, when fixed to the surfboard adjacent the side edges thereof, are sufficiently small to allow a swimmer's upper torso to fit on the planar member between the float members;

drilling holes in said float members and said surfboard;

passing fasteners through said float members and surfboard and fastening said fasteners to hold the float members on said surfboard; and including a buoyant extension fixed to each float member to extend past the rear edge of said surfboard and flex relative to the attached float member to add buoyancy and stability to the surfboard.

3. The method as defined in claim 1, including the step of adding a semi-rigid member internal to said float member supported extensions to strengthen them.

3. The method as defined in claim 6, including the step of bonding a reinforcing member external to each said float members at the area where the extension is fixed thereto.

* * * * *